US005156169A

United States Patent [19]

Holmes et al.

[11] Patent Number: 5,156,169

[45] Date of Patent: Oct. 20, 1992

[54] APPARATUS FOR MAKING CIGARETTES

[75] Inventors: Gregory A. Holmes; Clifford R. Marritt, both of Winston-Salem; John L. Nelson, Lewisville, all of N.C.

[73] Assignee: R. J. Reynolds Tobacco Company, Winston-Salem, N.C.

[21] Appl. No.: 609,975

[22] Filed: Nov. 6, 1990

[51] Int. Cl.[5] ..... A24C 5/10

[52] U.S. Cl. ..... 131/60; 131/58; 131/69; 493/39

[58] Field of Search ..... 131/58, 59, 60, 69, 131/84.1; 493/4, 39, 47

[56] References Cited

U.S. PATENT DOCUMENTS

| | | | |
|---|---|---|---|
| 2,866,465 | 12/1958 | Bunzl et al. | 131/69 X |
| 3,614,957 | 10/1971 | Verbakel | 131/69 X |
| 3,817,158 | 6/1974 | Reinbeck et al. | 493/39 |
| 4,474,190 | 9/1984 | Brand | 131/904 |
| 4,561,454 | 12/1985 | Guess | 131/365 |

*Primary Examiner*—V. Millin
*Assistant Examiner*—J. Doyle

[57] ABSTRACT

An apparatus for making smokable rods having smokable material contained in first and second wrapping materials, the first wrapping circumscribing the smokable material and the second wrapping material circumscribing and overwrapping the first wrapping material is provided. The apparatus includes a garniture means including a movable belt which travels along a predetermined path; a first bobbin for supplying a first wrapping material onto the movable belt of the garniture so as to travel along the path of the movable belt; and a second bobbin for supplying a second wrapping material onto the first wrapping material on the movable belt so as to travel along the path of the movable belt. The second bobbin supplies the second wrapping material using a turner assembly including a movable base; a first bar for receiving the second wrapping material from the second bobbin and for changing the path of the second wrapping material along a path substantially perpendicular to the path of the movable belt; and a second bar for receiving the second wrapping material from the first bar and for changing the path of the second wrapping material to a direction substantially parallel to the first wrapping material so as to place the second wrapping material onto the first while on the movable belt.

4 Claims, 3 Drawing Sheets

APPARATUS FOR MAKING CIGARETTES

BACKGROUND OF THE INVENTION

The present invention relates to an apparatus for making smokable rods having smokable material contained in first and second wrapping materials.

Popular smoking articles, such as cigarettes, have a substantially cylindrical rod shaped structure and include a charge of smokable material such as shredded tobacco (e.g., in cut filler form) surrounded by a wrapping material thereby forming a so-called "smokable rod", "cigarette rod" or "tobacco rod". Normally, a cigarette has a cylindrical filter element aligned in an end-to-end relationship with the tobacco rod. Typically, a filter element includes cellulose acetate tow circumscribed by plug wrap, and is attached to the tobacco rod using a circumscribing tipping material.

Cigarettes are employed by the smoker by lighting one end thereof and burning the tobacco within the rod. The smoker then receives mainstream smoke into his/her mouth by drawing on the opposite end (e.g., the filter end) of the cigarette. During the time that the cigarette is burning, sidestream smoke is generated. Sidestream smoke is smoke which directly enters the atmosphere from the lit end of the cigarette. Sidestream smoke diffuses into the atmosphere, and the characteristic visible nature thereof may be perceived negatively by some individuals. The relative amount of visible sidestream smoke generated by burning cigarette is related to the amount of sidestream "tar" generated by the burning cigarette. Typical cigarettes of about 84 mm length (e.g., having a tobacco rod length of about 57 mm and a filter element length of about 27 mm) often yield about 25 to about 35 mg of sidestream "tar" per cigarette. See, Proctor et al, *Analyst*. Vol. 113, p. 1509 (1988), for an apparatus and technique for determining the sidestream "tar" of a cigarette.

Numerous cigarettes which reportedly yield relatively low levels of visible sidestream smoke have been proposed. For example, cigarettes have been proposed which exhibit extremely low levels of visible sidestreams smoke as well as low levels of sidestream odor by using a smokable material contained in two layers of circumscribing wrapping materials to form a so-called "double-wrapped cigarette rod". See, for example, U.S. Pat. Nos. to Cline et al.; 4,225,636 to Guess U.S. Pat No. 4,561,454; and U.S. patent application Ser. No. 528,802, filed May 24, 1990.

However, the manufacture of double-wrapped cigarettes has several limitations. For example, special equipment is necessary in that commercially available cigarette manufacturing machines (e.g., a Protos cigarette manufacturing machine sold commercially by Hauni-Werke Korber and Co., KG, Hamburg, Germany) are equipped to provide to the garniture region, at a given time, only one layer of wrapping material from one bobbin. A single bobbin could be wound with more than one layer of wrapping material, but the bobbin must be wound carefully to insure that the layers of wrapping materials are in proper alignment to each other. The arrangement is cumbersome and results in the inefficient, slow operation of the cigarette manufacturing machine with the making of numerous low quality cigarettes and high rates of rejected cigarettes.

It would be desirable to provide an apparatus for making such double-wrapped cigarette rods in an efficient and effective manner.

SUMMARY OF THE INVENTION

The present invention relates to an apparatus that can be used advantageously to manufacture double-wrapped smokable rods or cigarette rods. Double-wrap cigarette rods include a charge or roll of smokable material (e.g., a smokable filler material comprising tobacco cut filler material) contained in two layers of circumscribing outer wrapping materials to form the rod. The cigarette rod is such that the first (i.e., outer) wrapping material circumscribes the second (i.e., inner) wrapping material which in turn circumscribes the smokable material, with the inner surface of the outer wrapping material contacting the outer surface of the inner wrapping material.

The present apparatus is capable of manufacturing continuous double-wrapped cigarette rods quickly (e.g. at rates in excess of about 400 m/min so as to provide 6,000 rods of 70 mm length per minute without a large rate of rejected cigarette rods) and efficiently, while maintaining the first and second wrapping materials in proper alignment to each other. The apparatus comprises a garniture, a first supply unit for supplying from a first bobbin a first outer wrapping material, a second supply unit for supplying from a second bobbin a second inner wrapping material and means for providing smokable material onto the second wrapping material. The garniture includes a movable belt which travels along a predetermined path onto which the first and second wrapping materials are supplied. The second means for supplying the second wrapping material includes a turner assembly. The turner assembly comprises a movable base, a first bar for receiving the second wrapping material from the second bobbin and for changing the path of the second wrapping material along a path substantially perpendicular to the path of the movable belt and a second bar for receiving the second wrapping material from the first bar and for changing the path of the second wrapping material to a direction substantially parallel to the first wrapping material so as to place the second wrapping material onto the first wrapping material while on the movable belt.

DETAILED DESCRIPTION OF THE PREFERRED EMBODIMENTS

Figure 1:
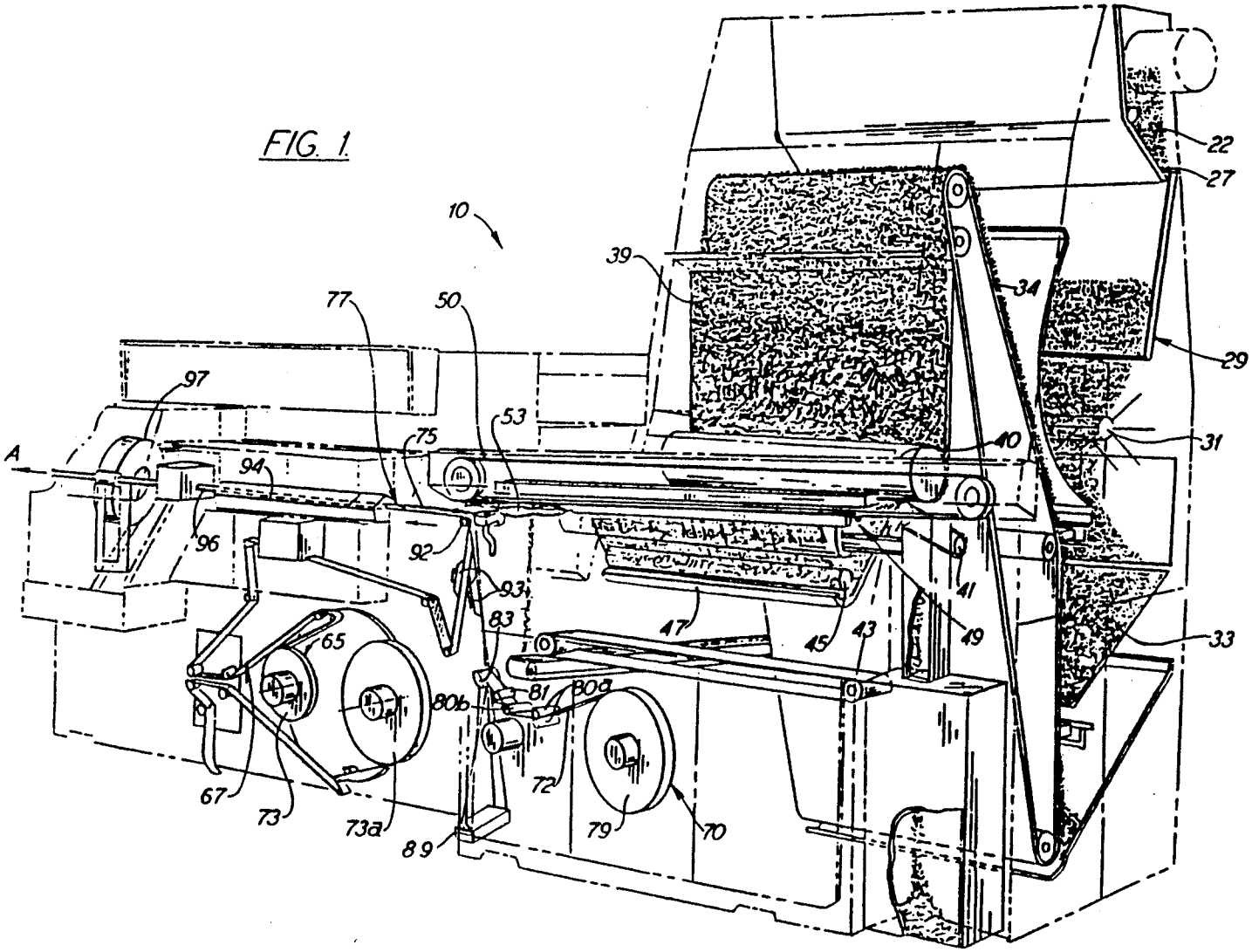
FIG. 1 is a perspective illustration of a cigarette manufacturing apparatus including the apparatus of the present invention.

Referring to FIG. 1, a cigarette making machine 10 including the turner assembly 15 of the present invention is shown. A representative cigarette making machine 10 is shown and is used to manufacture the double-wrapped smokable rods or illustrated cigarette rods 20 shown in FIGS. 4 and 4A. The cigarette making machine 10 is sold commercially by Hauni-Werke Korber and Co., KG, Hamburg, Germany and is described in their Brand U.S. Pat. No. 4,474,190, herein incorporated by reference.

The cigarette making machine 10 is designed to manufacture cigarettes at a rate which is in excess of 6000 rods of 70 mm length per minute and is directly coupled with a filter tipping machine (not shown). One representative tipping machine is sold commercially as the "MAX 80" by Hauni-Werke Korber and Co., KG, Hamburg, Germany. The cigarette making machine 10 generally includes a preliminary distributor 22 for forming a layer of smokable material (e.g., tobacco material) and having a pivotal gate 27 wherein tobacco is fed into the machine. A first distributor 29 receives batches of smokable tobacco material by way of the gate 27 and a rotary drum-shaped conveyor 31 directs the tobacco material to a bulking chute or reservoir 33. A steep angle endless band conveyor 34 draws tobacco material particles from the chute 35 to an upright duct 39. The tobacco material advances via a rotary drum-shaped metering device 40 or other means for providing the smokable or tobacco material which cooperates with a rapidly rotating picker roller (not shown) to form the layer of tobacco on an apron conveyor 41. Tobacco material from the apron conveyor 41 is caused to enter a funnel 43 by a curtain of air. The funnel 43 is defined by a drum-shaped rotary accelerator 45 and stationary wall member 47. The funnel 43 discharges successive increments of tobacco material into an elongated inverted narrow channel 49 defining a predetermined path and providing a means for conveying for the layer of tobacco. The layer grows in the channel 49 and advances lengthwise, i.e., in direction of arrow A.

The inverted channel 49 is formed in part by an endless foraminous belt conveyor 50 or other conveying means located in the top of the channel. Such a conveyor 50 travels along a predetermined path also in direction of arrow A. The conveyor 50 propels the particles of tobacco material against the exposed side of the conveyor in the inverted channel 49, and such particles are attracted to the conveyor 50 under the influence of a vacuum so that the particles form a growing wedge-like stream or layer of tobacco material. The layer of tobacco, when fully grown, advances past a conventional trimming or equalizing device 53 serving to remove the surplus or excess of tobacco particles so that the fully grown layer of tobacco is converted into a trimmed or equalized rod-like smokable material. The smokable material is then deposited onto a double layer of wrapping material (not shown). It is recognized that other means for providing smokable material onto the double layer of wrapping material will be known to those skilled in the art.

The double layer of wrapping materials is supplied from a first supply unit 65 for supplying the first (i.e., outer) wrapping material 67 and from a second supply unit 70 for supplying the second (i.e., inner) wrapping material 72. Other means for supplying the first and second wrapping materials will be known to those skilled in the art. The first supply unit 65 preferably includes an expiring bobbin 73 wound with the first wrapping material 67 and mounted on a frame adjacent to a fresh bobbin 73*a*. The first wrapping material 67 is drawn off the expiring bobbin 73 onto a movable belt 75 of a garniture 77 or other means for advancing the rod-like smokable material and for advancing the wrapping materials along a predetermined path in direction of arrow A. The second supply unit 70 preferably includes a second bobbin 79 wound with the second wrapping material 72, and a turner assembly 15. The second wrapping material 72 is drawn off the second bobbin 79 and fed to the turner assembly 15.

Figure 2:
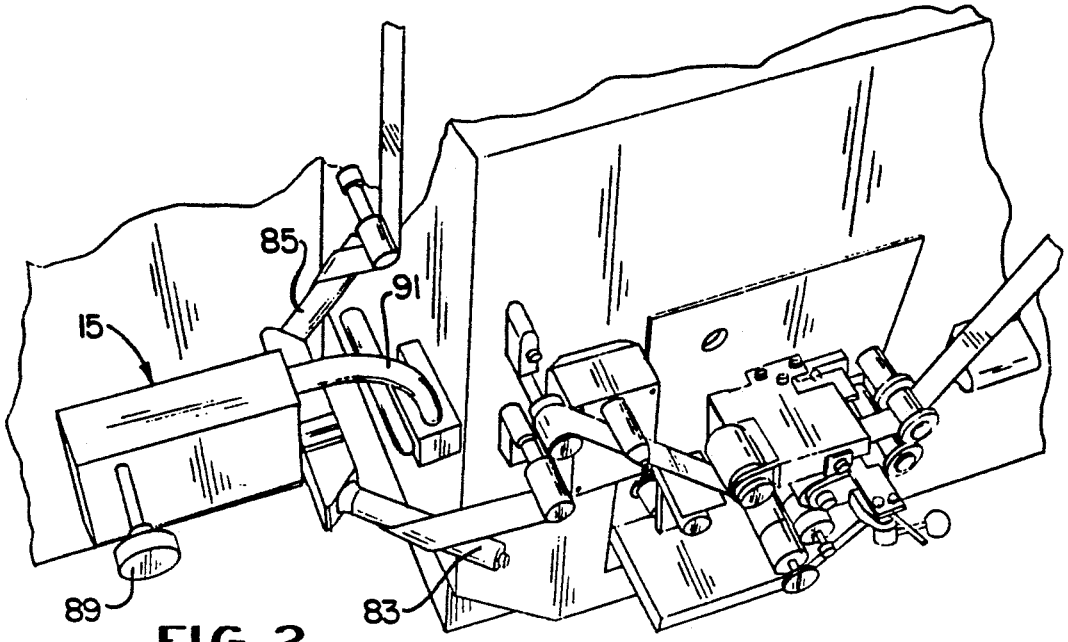
FIG. 2 is an enlarged perspective view of the apparatus of the present invention.
Figure 3A:
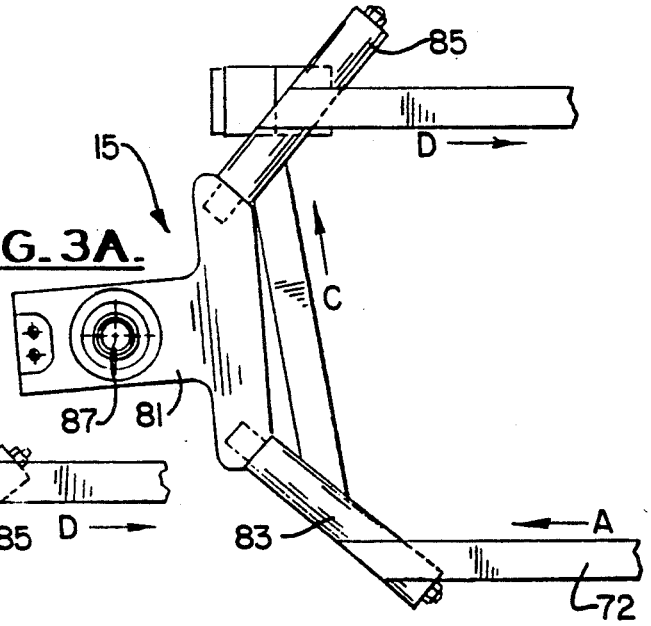
FIGS. 3A and 3B are top plan views of the turner assembly of the apparatus of the present invention.
Figure 3B:
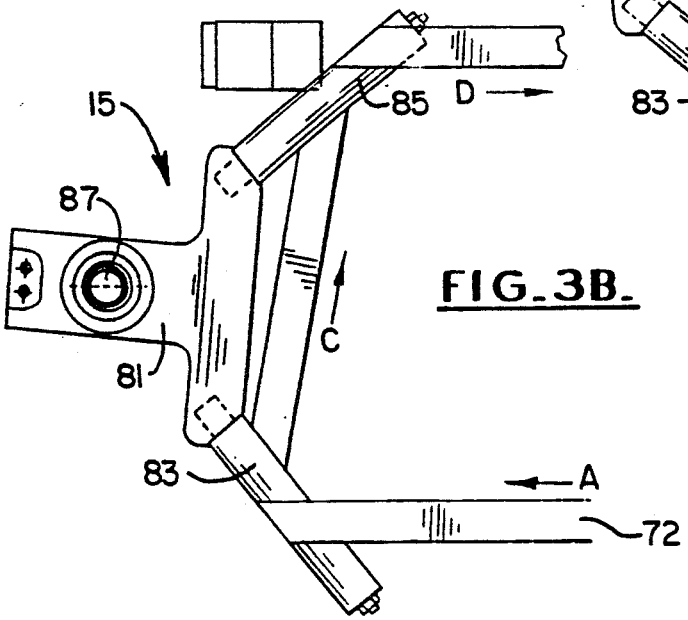

Referring to FIGS. 2, 3A and 3B, the turner assembly 15 includes a movable base 81, a first bar 83 and a second bar 85. The movable base includes a pivot 87 or other means for moving the base and an adjustment knob 89 or other means for adjusting the overall position of the turner assembly 15 and thus the alignment of the inner second wrapping material with respect to the outer first wrapping material. Preferably a 360° turn of the knob 89 (i.e. one full turn of the knob) corresponds to an adjustment of 1 mm of the inner second wrapping material relative to the outer first wrapping material.

The second wrapping material 72 from the second bobbin 79 is received by the first bar 83 of the turner assembly 15 and changes the path of the second wrapping material 72 from its initial path which is substantially parallel and vertically spaced from the path of the movable belt 75 along a path in direction of arrow C at angle of about 80° to about 100° relative to the direction of arrow A of the movable belt 75. The second wrapping material 72 is then received from the first bar 83, and the second bar 85 changes the path of the second wrapping material in direction of arrow D parallel to the direction of arrow A so as to place the second wrapping material onto the first wrapping material in proper alignment with each other while on the movable belt 75. Preferably, this alignment is such that the inner second wrapping material is offset from the centerline of the outer first wrapping material. The first bar 83 and second bar 85 are preferably fixedly mounted in the movable base 81 at an angle relative to the movable base (e.g., at an angle of about of 45°±10°) such that the first bar 83 changes the path of the second wrapping material in direction of arrow C, at an angle of from about 80° to about 100° relative to the path, in direction of arrow A, of the movable belt 75, and such that the second bar 85 changes the path of second wrapping material so as to place the second wrapping material onto the first wrapping material. The first bar 83 and second bar 85 are preferably about 6 inches long and have about an 1 inch outside diameter. The bars are preferably manufactured from stainless steel, but could also be manufactured from other alloys (e.g., bronze, nickel, etc.). In a preferred embodiment, the first bar 83 and the second bar 85 are manufactured from porous stainless steel and are associated with an air source via a support tube connected to an opening (not shown) in the first and second bars 91. The porous stainless steel bars are such that an even flow of air is transported through the center of the first and second bars such that a layer of air is provided to the outer layers of the first bar and the second bar for reducing friction between the first bar and the second wrapping material and the second bar and the second wrapping material. The air pressure required from the air source is typically up to about 45 psi. By providing a layer or cushion of air between the second wrapping material and the bars, the movement of the second wrapping material is facilitated and the second wrapping material can be advanced at a rate of about 400 m/min and about 6,000 cigarette rods of about 70 mm length per minute without a large rate of rejected cigarette rods can be made. An exemplary porous stainless steel bar is available from Mott Metallurgical Corporation, Farmington, Conn. Other means for reducing friction between the second wrapping material and the first and second bars will be known to those skilled in the art.

The first wrapping material fed from the first supply unit 65 and the second wrapping material fed from the turner assembly 15 of the second supply unit 70 are delivered to a bullet roll 92 then to the movable belt 75 to a draping mechanism 94. This mechanism is designed to drape the wrapping material around the rod-like smokable material so that one marginal portion of the partially draped wrapping materials extends away from the smokable material and one side thereof preferably the outer first wrapping material, can be coated with a suitable adhesive (e.g., a wet adhesive or a hot melt) by a conventional paster or other means for providing an adhesive before the adhesive-coated marginal portion is folded over the other marginal portion to form therewith a seam extending in parallelism with the axis of the resulting continuous cigarette rod. The seam is heated or cooled depending on the adhesive to ensure that the seam can stand stresses which arise when the continuous rod is severed at regular intervals during travel through a cutoff 97 so as to yield a single file of discrete plain cigarette rods of double unit length.

Figure 4:
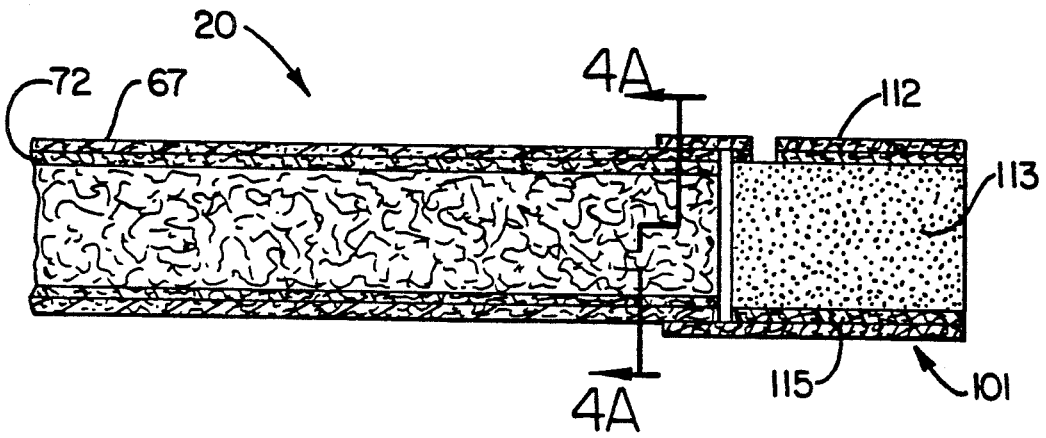
FIG. 4 is a longitudinal sectional view of a cigarette rod made using the apparatus of this invention.
Figure 4A:
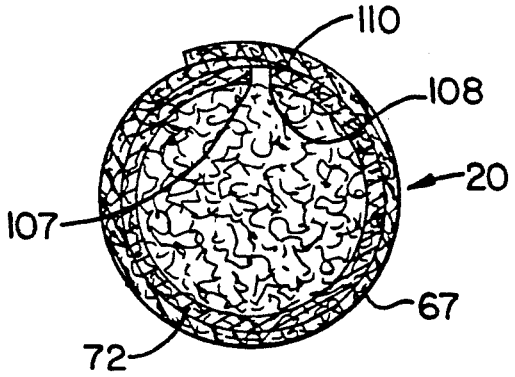
FIG. 4A is a cross-sectional radial view of the cigarette rod shown in FIG. 4 taken along lines 4—4 in FIG. 4.

The resulting double-wrapped smokable or cigarette rods 20 formed using such a machine can be of the type described in U.S. patent application Ser. No. 528,802 filed May 24, 1990, herein incorporated by reference. Referring to FIGS. 4 and 4A, the smokable or cigarette rods 20 include rod-like smokable material contained in the second circumscribing inner wrapping material 72 and a first or outer wrapping material 67 circumscribing the second wrapping material. The first and second circumscribing wrapping materials directly contact one another (i.e., the inner surface of the outer wrapping material contacts the outer surface of the inner wrapping material). As such, the outer wrapping material overwraps the inner wrapping material. The ends of the cigarette rods are open to expose the smokable material. The smokable rods also include a filter element 101 positioned adjacent one end of the rod-like smokable material such that the filter element and rod-like smokable material are axially aligned in an end-to-end relationship, preferably abutting one another. First element 101 has a generally cylindrical shape, and the diameter thereof is essentially equal to the diameter of the cigarette rod. The ends of the filter element are open to permit the passage of air and smoke therethrough.

Referring to FIG. 4A, preferably the second wrapping material 72 is formed into a circular shape such that the ends 107, 108 of the sides thereof abut one another. The ends 107, 108 of wrapping material 72 can abut one another (as shown in FIG. 4A), nearly abut one another, or slightly overlap one another. The first wrapping material 67 includes a lap zone 110 including a suitable adhesive therebetween so as to form a secure outer wrapper. As such the width of the inner wrapping material is less than that of the outer wrapping material and the proper alignment thereof is maintained using the turner assembly 15.

The smokable material employed in manufacture of the smokable rod can vary. For example, the smokable material of the cigarette can have the form of filler (e.g., such as tobacco cut filler). As used herein, the terms "filler" or "cut filler" are meant to include tobacco materials and other smokable materials which have a form suitable for use in the manufacture of tobacco rods for cigarettes. As such, filler can include smokable materials which are blended and are in a form ready for cigarette manufacturer. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Maryland or Oriental tobaccos, the rare or specialty tobaccos, and blends thereof. The tobacco material can be provided in the form of tobacco lamina; processed tobacco, processed tobacco stems such as cut-rolled or cut-puffed stems, reconstituted tobacco materials; or blends thereof. Certain reconstituted tobacco materials are described in U.S. patent application Ser. Nos. 414,833, filed Sep. 29, 1989, 416,332, filed Sep. 29, 1990, and 406,637, filed Sep. 13, 1989. Preferably, the smokable material or blend of smokable materials consists essentially of tobacco filler material. Smokable materials can also be cased and top dressed as is conventionally performed during various stages of cigarette manufacture.

Typically, the smokable rod has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 to about 50 mm) can be employed, particularly when smokable blends having a relatively high packing density are employed.

The first or outer wrapping material 67 can vary, and typically is a cigarette wrapping material having a low air permeability value. For example, such wrapping materials can have air permeabilities of less than about 5 CORESTA units. Such wrapping materials include a cellulosic base web (e.g., provided from wood pulp and/or flax fibers) and inorganic filler material (e.g., calcium carbonate and/or magnesium hydroxide particles). A suitable wrapping material is a cigarette paper consisting essentially of calcium carbonate and flax. Particularly preferred first or outer wrapping materials include an amount of a polymeric film forming agent sufficient to provide a desirably low air permeability. Exemplary first or outer wrapping materials are P-2540-80, P-2540-81, P-2540-82, P-2540-83, P-2540-84, and P-2831-102 available from Kimberly-Clark Corporation and TOD 03816, TOD 05504, TOD 05560 and TOD 05551 available from Ecusta Corporation.

The second or inner wrapping material 72 preferably comprises carbonaceous material (i.e., a material consisting primarily of carbon) and a cellulosic (e.g., base web) material. If desired, a certain amount of inorganic filler material (e.g., calcium carbonate and/or magnesium hydroxide) can be incorporated into the paper along with the cellulosic and carbonaceous materials. The amount of carbonaceous material within the wrapping material can vary.

Other exemplary inner wrapping materials include papers including tobacco parts and wood pulp. Also suitable papers include wood pulp, tobacco stem and calcium carbonate and magnesium hydroxide particles. Exemplary inner wrapping materials are P-2269-82, P-2540-94-A, P-2540-107-B, P-2540-107-C, P-2540-107-

D, P-2540-94C, P-2540-94-D, P-144-KC-G, P-144-RB, P-144-KCL, P-144-SN20, P-144 BHC, P-2540-136-E, P-1976-25-1, P-1976-25-2, P-1976-25-3 and P-1224-67 available from Kimberly-Clark Corporation.

The packing densities of the blend of smokable materials contained within the wrapping materials can vary. Typical packing densities for cigarette rods of this invention range from about 150 to about 300 mg/cm$^3$. Normally, packing densities of the cigarette rods range from about 200 to about 280 mg/cm$^3$.

The filter element 101 normally is attached to the cigarette rod by tipping material 112 which circumscribes both the entire length of the filter element and an adjacent region of the cigarette rod. The inner surface of the tipping material 112 is fixedly secured to the outer surface of the plug wrap and the outer surface of the wrapping material of the smokable rod, using a suitable adhesive.

Typically, the filter element 101 has a length which ranges from about 15 mm to abut 35 mm, preferably about 25 mm to about 30; and a circumference of about 17 mm to about 27 mm, preferable about 22 mm to about 25 mm. Filter material 113 normally is provided from fibrous materials such a cellulose acetate or polyporpylene tow. The plug wrap 115 typically is a conventional paper plug wrap, and can be either air permeable or essentially air impermeable. However, if desired, non-wrapped cellulose acetate filter elements can be employed to provide the various segments. The filter elements can provide a wide range of mainstream smoke removal efficiencies.

Preferred filter elements provide minimal mainstream smoke removal efficiencies while maintaining the desirable draw characteristics of the cigarette. Such minimal smoke removal efficiencies are provided by the so-called "low efficiency" filter elements. Low efficiency. The low efficiency filter element is desirable used herein in order that the relatively low "tar" yield is obtained primarily as a result of a relatively high level of filter ventilation or air dilution. Such cigarette configurations provide a means for reducing the yields of mainstream gaseous components.

Typically, the tipping material circumscribes the filter element and a adjacent region of the smokable rod such that the tipping material extends about 3 mm to about 6 mm along the length of the smokable rod. Typically, the tipping material is a conventional paper tipping material and is adhesively secured to the filter element and the adjacent region of the tobacco rod. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

We claim:

1. An apparatus for making smokable rods having smokable material contained in first and second wrapping materials, the second wrapping circumscribing the smokable material and the first wrapping material circumscribing and overwrapping the second wrapping material, the apparatus comprising:

(a) garniture means including a movable belt which travels along a predetermined path;

(b) first means for supplying from a first bobbin a first wrapping material onto the movable belt of the garniture means so as to travel along the path of the movable belt;

(c) second means for supplying from a second bobbin a second wrapping material onto the first wrapping material on the movable belt; the second means for supplying including a turner assembly comprising (i) a movable base;

(ii) a first bar for receiving the second wrapping material from the second bobbin and for changing the path of the second wrapping material along a path substantially perpendicular to the path of the movable belt; and (iii) a second bar for receiving the second wrapping material from the first bar and for changing the path of the second wrapping material to a direction substantially parallel to the first wrapping material so as to place the second wrapping material onto the first while on the movable belt, the first bar and second bar fixedly mounted in the movable base; and (d) means for providing smokable material onto the second wrapping material.

2. An apparatus according to claim 1 wherein the first means for supplying from the first bobbin includes means for providing an adhesive to an overlap of marginal portions of the first wrapping material to form a rod.

3. An apparatus according to claim 1 wherein the first bar and second bar of the turner assembly includes means for reducing friction between the first bar and the second wrapping material, and the second bar and the second wrapping material.

4. An apparatus according to claim 3 wherein the means for reducing friction includes means for providing a layer of air to an outer surface of each of the first and second bars.

* * * * *